US009276302B2

(12) United States Patent
Henderson et al.

(10) Patent No.: US 9,276,302 B2
(45) Date of Patent: Mar. 1, 2016

(54) WAVEGUIDE ROTARY JOINT INCLUDING HALF-HEIGHT WAVEGUIDE PORTIONS

(71) Applicant: ThinKom Solutions, Inc., Torrance, CA (US)

(72) Inventors: William Henderson, Bedford, NH (US); James Sor, San Pedro, CA (US); William Milroy, Torrance, CA (US); Jonathan Sala, Redondo Beach, CA (US)

(73) Assignee: ThinKom Solutions, Inc., Hawthorne, CA (US)

( * ) Notice: Subject to any disclaimer, the term of this patent is extended or adjusted under 35 U.S.C. 154(b) by 58 days.

(21) Appl. No.: 14/078,714

(22) Filed: Nov. 13, 2013

(65) Prior Publication Data

US 2015/0130565 A1 May 14, 2015

(51) Int. Cl.
*H01P 1/06* (2006.01)
*H01P 5/02* (2006.01)

(52) U.S. Cl.
CPC ..... *H01P 1/062* (2013.01); *H01P 1/067* (2013.01); *H01P 5/026* (2013.01)

(58) Field of Classification Search
CPC ..... H01P 1/062; H01P 1/066; H01P 1/067; H01P 1/069
USPC ..... 333/256, 257, 261
See application file for complete search history.

(56) References Cited

U.S. PATENT DOCUMENTS

| | | | | | |
|---|---|---|---|---|---|
| 2,830,276 | A | * | 4/1958 | Zaleski | 333/256 |
| 2,962,677 | A | * | 11/1960 | Edwards | 333/27 |
| 3,011,137 | A | * | 11/1961 | Albanese et al. | 333/256 |
| 3,514,778 | A | * | 5/1970 | Titus | 343/705 |
| 3,599,127 | A | * | 8/1971 | Krijger | 333/256 |
| 3,681,714 | A | * | 8/1972 | Terakawa | 333/21 R |
| 4,020,431 | A | * | 4/1977 | Saunders | 333/256 |
| 5,398,010 | A | * | 3/1995 | Klebe | 333/239 |
| 5,434,548 | A | * | 7/1995 | Thompson et al. | 333/261 |
| 2005/0264377 | A1 | | 12/2005 | Faulkner et al. | |

FOREIGN PATENT DOCUMENTS

| | | | |
|---|---|---|---|
| JP | S52 146147 | A | 12/1977 |
| WO | WO 02/45202 | A1 | 6/2002 |
| WO | WO 2012/016665 | A1 | 2/2012 |

OTHER PUBLICATIONS

Extended European Search Report dated Apr. 2, 2015 for corresponding EP application No. 14192196.5 filed Nov. 7, 2014.

* cited by examiner

*Primary Examiner* — Benny Lee
(74) *Attorney, Agent, or Firm* — Renner, Otto, Boisselle & Sklar, LLP

(57) ABSTRACT

A waveguide rotary joint includes a first waveguide portion for receiving a microwave signal, a second waveguide portion for outputting the received microwave signal, and a conductive pin including a first end and a second end distal from the first end, the first end arranged in and RF coupled to the first waveguide, and the second end arranged in and RF coupled to the second waveguide, and a choke cavity is arranged between the first waveguide portion and the second waveguide portion. The first waveguide and the second waveguide are rotatable relative to each other about a longitudinal axis of the conductive pin.

19 Claims, 7 Drawing Sheets

WAVEGUIDE ROTARY JOINT INCLUDING HALF-HEIGHT WAVEGUIDE PORTIONS

TECHNICAL FIELD

The present invention relates generally to rotary joints and, more particularly, to a rotary joint for use with microwave antennas, and systems incorporating the same.

BACKGROUND ART

Mobile satellite communications (SATCOM) is emerging as an increasingly important upcoming technology, and low-profile antennas figure to play a prominent role in mobile SATCOM. These low-profile systems and antennas are highly desired for aeronautical applications in order to minimize drag and reduce fuel consumption. Such antennas also enable lower profile protective radome enclosures, significantly lowering the overall operational costs of the antenna system.

Variable inclination continuous transverse stub (VICTS) antennas are extremely low profile phased array antennas with low loss and excellent gain. A compact, low-profile waveguide rotary joint is an important component in these antennas since the antennas operate by rotating individual platters with respect to one another to electromechanically steer a main beam to a target satellite. The input waveguide feeding structure for these antennas is normally located away from the rotational center and as such, a waveguide rotary joint structure which provides a continuous free-rotating microwave connection between the rotating feed structure and the fixed antenna mount is needed.

Existing waveguide rotary joints are not only relatively large, but also expensive. For ground mobile applications, low-profile antennas are highly desired not just for aesthetics but also to reduce drag and fuel consumption when vehicles are in motion. For aeronautical applications, drag becomes even more paramount as the single most important determinant of fuel economy in an aircraft.

Commercial off-the-shelf waveguide rotary joints are available. Almost all fall into one of two types, with a central rotating joint employing a coaxial or circular waveguide.

Coaxial rotary joints can be smaller in profile and footprint than those employing a circular waveguide. However, due to the coaxial transmission medium implemented in coaxial rotary joints, they are much lossier and have lower-power handling capabilities relative to circular waveguide rotary joints. Further, when these coaxial rotary joints are used in a rectangular waveguide system, much of the height and profile advantages are negated due to the need to employ multiple coaxial-to-waveguide transitions. Multiple channel alternatives to coaxial rotary joints employ a long cable-wrap comprised of multiple independent coaxial cables, but these are typically limited to 720 degrees or less of rotation and then have to "reset" the cable wrap to avoid permanent damage.

Circular waveguide rotary joints, on the other hand, offer lower loss and improved power-handling capabilities at the expense of a much larger profile and diminished operational frequency bandwidth. The rectangular waveguide sections are attached to the circular waveguide section such that only the TM01 mode is excited inside the circular waveguide. Due to the type of modes excited, this type of construction requires special choking features which significantly increases the height of the assembly and serves to further limit operating frequency bandwidth.

SUMMARY OF THE INVENTION

A waveguide rotary joint in accordance with the present invention provides a significantly lower profile ground mobile vehicle mounted earth station (VMES) system than conventional Ku-Band solutions. The waveguide rotary joint in accordance with the present invention employs unique design considerations to enable advantages of both coaxial and circular waveguide rotary joints. For example, the waveguide rotary joint in accordance with the invention utilizes a half-height waveguide leading into very low-profile back-to-back waveguide-to-coaxial transitions, which enables a much lower overall height profile (e.g., 0.6 inches vs. 2 inches). A center pin in the coaxial region is non-contact with an outer conductor, thereby enabling broader-band and more compact coaxial waveguide operation as opposed to the band-limited and bulky circular waveguide. Further, a center coaxial-like transition eliminates the need for TM01 mode suppressing chokes, which can add significant height in circular waveguide based rotary joints.

Other benefiting applications include, but are not limited to, other microwave (MW) and millimeter-wave (MMW) operating frequency bands for various aeronautical and ground-mobile SATCOM systems, terrestrial and line-of-sight communication links, various radar applications, and industrial manufacturing equipment utilizing microwave frequencies in moving/rotating machinery.

According to one aspect of the present disclosure, a waveguide rotary joint includes: a waveguide rotary joint portion including a first waveguide portion for receiving a microwave signal, and a second waveguide portion for outputting the received microwave signal; a coaxial rotary joint portion including a conductive pin having a first end and a second end distal from the first end; and a choke cavity arranged between the first waveguide portion and the second waveguide portion, wherein the first end is arranged in and RF coupled to the first waveguide portion, the second end is arranged in and RF coupled to the second waveguide portion, and the first waveguide portion and the second waveguide portion are rotatable relative to each other about a longitudinal axis of the conductive pin.

According to one aspect of the present disclosure, the coaxial rotary joint portion comprises a floating coaxial connection between the first waveguide portion and the second waveguide portion.

According to one aspect of the present disclosure, the coaxial connection is fixed relative to the first waveguide portion and floating relative to the second waveguide portion.

According to one aspect of the present disclosure, the conductive pin is arranged to electrically float such that there is no direct-current contact between the first waveguide portion and the second waveguide portion.

According to one aspect of the present disclosure, the choke cavity is defined by a first surface, a second surface opposite the first surface, and an exterior sidewall connecting the first surface to the second surface.

According to one aspect of the present disclosure, the choke cavity further comprises an interior sidewall connecting the first surface to the second surface, the interior sidewall spaced apart from the exterior sidewall.

According to one aspect of the present disclosure, the waveguide rotary joint includes a center section coupled to at least one of the first surface or the second surface, wherein the center section is concentric with the choke cavity.

According to one aspect of the present disclosure, the center section is arranged in a center of rotation of the choke cavity.

According to one aspect of the present disclosure, the choke cavity comprises air.

According to one aspect of the present disclosure, the waveguide rotary joint includes a sleeve coaxial with the conductive pin.

According to one aspect of the present disclosure, the sleeve comprises Polytetrafluoroethylene.

According to one aspect of the present disclosure, the waveguide rotary joint includes a conductive material arranged on at least a portion of an outer surface of the sleeve, the conductive material electrically coupling the choke cavity to one of the first or second waveguides.

According to one aspect of the present disclosure, the conductive pin, sleeve, and the conductive material form a coaxial conductor.

According to one aspect of the present disclosure, the conductive pin comprises an elongated portion arranged between the first end and the second end, and a diameter of the elongated portion is less than a diameter of the first end and the second end.

According to one aspect of the present disclosure, the waveguide rotary joint includes an RF absorbing layer arranged on the first surface and the second surface.

According to one aspect of the present disclosure, the RF absorbing layer comprises rubber embedded with iron particles.

According to one aspect of the present disclosure, the conductive pin comprises at least one of aluminum, copper or brass.

According to one aspect of the present disclosure, at least one of the first wave guide or the second wave guide comprises plastic plated with copper, or aluminum.

According to one aspect of the present disclosure, the waveguide rotary joint includes a first waveguide coupled to the first waveguide portion and a second waveguide coupled to the second waveguide portion.

According to one aspect of the present disclosure, the first waveguide portion and the second waveguide portion comprise half-height waveguides.

According to one aspect of the present disclosure, a waveguide rotary joint includes: a first waveguide-to-coaxial transition including a first waveguide portion for receiving a microwave signal from a first waveguide, and a first coaxial portion, wherein the first coaxial portion is coupled to the first end of the conductive pin; a second waveguide-to-coaxial transition including a second waveguide portion for transmitting the microwave signal to a second waveguide, and a second coaxial portion, wherein the second coaxial portion is coupled to the second end of the conductive pin; and a choke cavity arranged between the first waveguide portion and the second waveguide portion, wherein the first waveguide and the second waveguide are rotatable relative to each other about a longitudinal axis of the conductive pin.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

In the annexed drawings, like references indicate like parts or features.

DETAILED DESCRIPTION OF THE INVENTION

Figure 1:
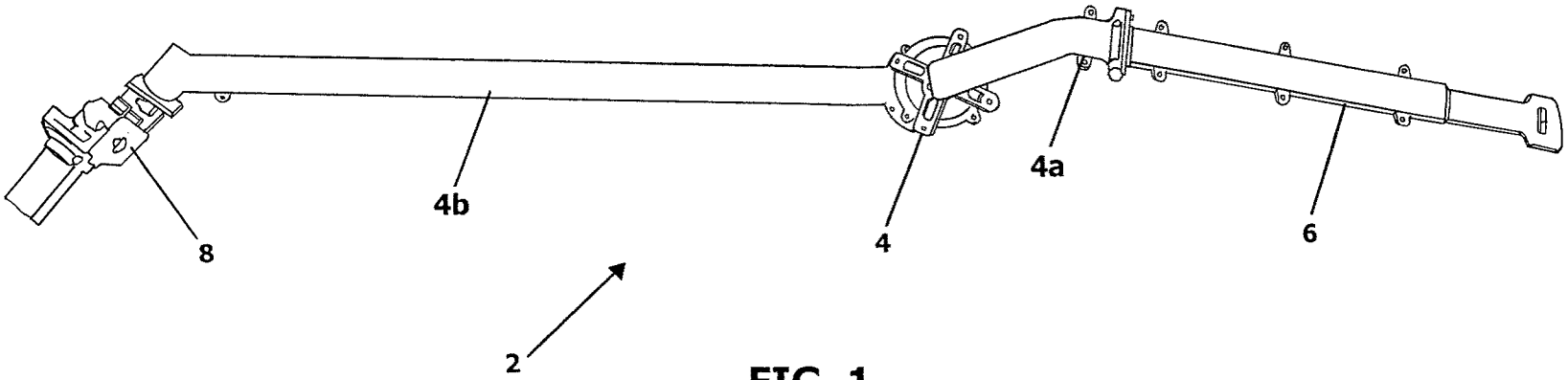
FIG. 1 is a schematic diagram of a system employing an exemplary waveguide rotary joint in accordance with the present invention.

As used herein, a waveguide is defined as an enclosed microwave transmission line structure, with a mechanical cross-section largely rectangular in shape, and comprised of conductive upper, lower, and side surfaces within which the propagating energy is contained.

As used herein, a choke is defined as microwave structure which utilizes non-contacting inductive and/or capacitive features (suitably positioned and typically realized as conductive channels or irises) as a surrogate for a contacting microwave joint or RF conductive seal between two distinct conducting surfaces.

A waveguide rotary joint in accordance with the present invention provides a rotatable joint in a very compact form that is significantly lower in profile (70% lower) than available commercial off-the-shelf (COTS) solutions. More particularly, the waveguide rotary joint in accordance with the present invention provides a hybrid rotary joint that employs features from both coaxial and waveguide rotary joints. The joint includes a waveguide rotary joint portion having a first waveguide portion for receiving a microwave signal, and a second waveguide portion for outputting the received microwave signal. The joint also includes a coaxial rotary joint portion having a conductive pin with a first end and a second end distal from the first end. A choke cavity can be arranged between the first waveguide portion and the second waveguide portion. Further, the first end can be arranged in and RF coupled to the first waveguide portion, the second end can be arranged in and RF coupled to the second waveguide portion. The first waveguide portion and the second waveguide portion are rotatable relative to each other about a longitudinal axis of the conductive pin. RF absorbing material is used in the mechanical seams to prevent resonances from occurring between reflection points in the transition.

The rotary joint and all connecting waveguide pieces are designed for optimal match and minimum insertion loss. These careful design considerations allow good match and low insertion loss with very consistent performance over all rotations of the assembly. Further, the non-contacting center pin facilitates unencumbered 360° rotation without any mechanical hard stops or the need to reset after so many revolutions.

The low-profile waveguide rotary joint in accordance with the present invention can be utilized in any system that requires routing of RF energy through a rotational center spindle, such as, for example, a system of platters or layers that rotate about the spindle. The waveguide rotary joint is particularly beneficial in airborne antenna systems that must maintain very low profiles to lower drag and fuel consumption. The waveguide rotary joint also can be utilized in other applications where RF routing through a mechanical center of rotation is required. Exemplary applications include radar, microwave industrial equipment, microwave gimbals, and antennas.

For example, the waveguide rotary joint in accordance with the present invention can be used in low-profile VICTS antenna systems, which are a lower-cost alternative to phased array systems. A distinguishing feature of a VICTS antenna is its extremely low profile which is made in part possible by the waveguide rotary joint in accordance with the present invention.

Referring initially to FIG. 1, a system 2 for transmitting and/or receiving microwave signals is shown, the system 2 including a waveguide rotary joint 4 in accordance with the present invention. More specifically, a first waveguide portion 4*a* of the rotary joint 4 is coupled to a first waveguide 6, and a second waveguide portion 4*b* of the rotary joint 4 is coupled to a second waveguide 8. The first and second waveguides 6 and 8 as well as the first and second waveguide portions 4*a* and 4*b* can be formed, for example, as half-height waveguides.

Standard waveguides normally have a 2:1 aspect ratio cross-section. For example, standard WR75 waveguide for Ku-Band utilizes a 0.750"×0.375" cross-section. The waveguide rotary joint 4 in accordance with the invention utilizes half-height waveguide which reduces the smaller "b" dimension (0.750"×0.188" for half-height WR75) compared to standard WR75. The use of half-height waveguides minimizes the overall height profile of the waveguide rotary joint 4.

A microwave signal communicated to the first waveguide 6, for example, via a first device (not shown) is provided to the first waveguide portion 4*a*, transferred to the second waveguide portion 4*b*, and then provided to the second waveguide 8. The second waveguide 8 then communicates the signal to a second device (not shown). As will be appreciated, and based on the inherent reciprocal nature of the device, the signal flow may be reverse from that described above.

As noted above, the rotary joint 4 can continuously rotate about 360 degrees, thus enabling the orientation of the first waveguide 6 relative to the second waveguide 8 to be varied. Moreover, the rotary joint 4 in accordance with the present invention provides improved signal response, while also providing a smaller overall footprint.

Figure 2:
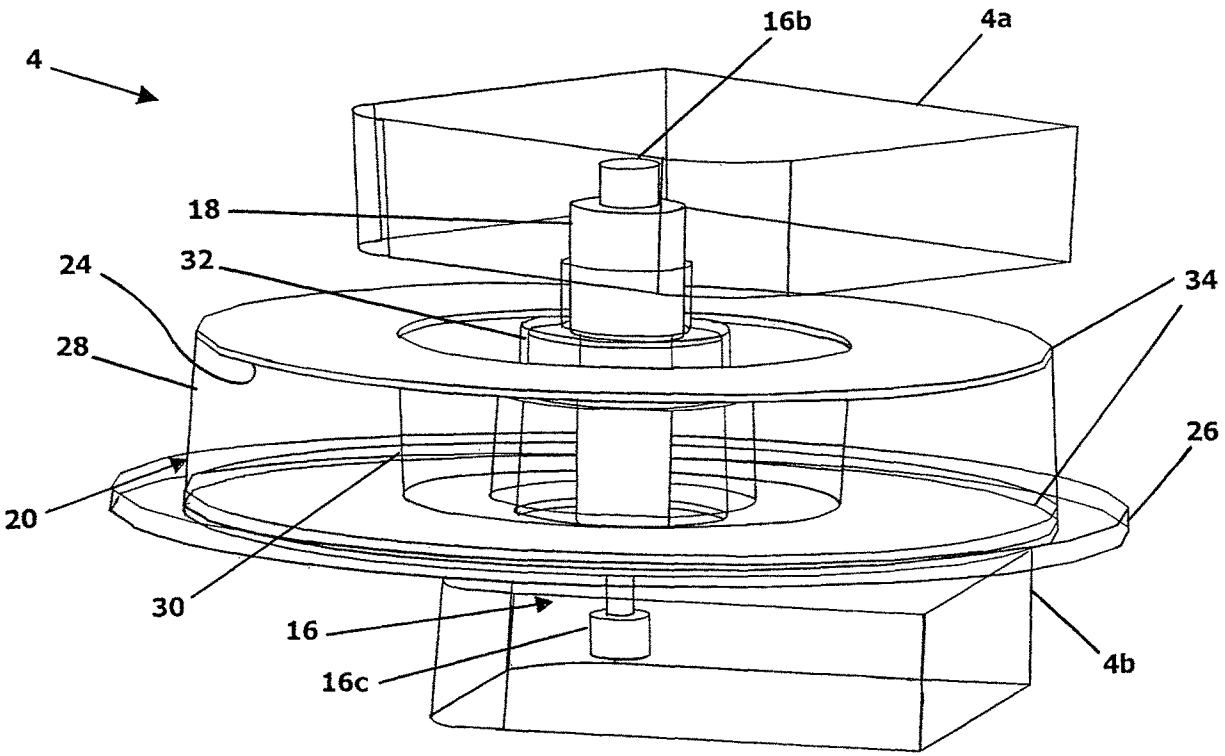
FIG. 2 is an isometric view of an exemplary waveguide rotary joint in accordance with the present invention.
Figure 3:
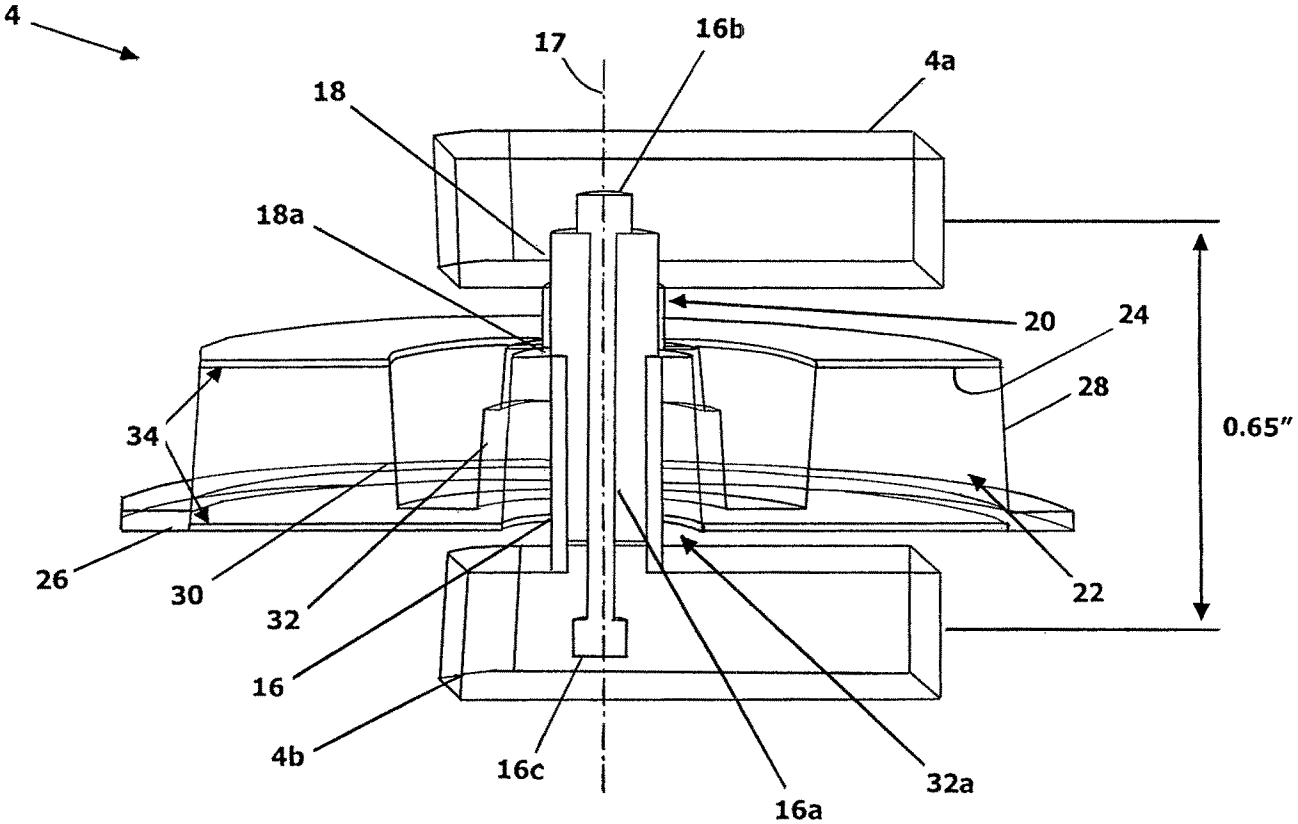
FIG. 3 is a cross-sectional view of the waveguide rotary joint of FIG. 2.

Moving to FIGS. 2 and 3, the exemplary waveguide rotary joint 4 in accordance with the present invention is shown in more detail. The waveguide rotary joint 4 includes a first waveguide portion 4*a* for receiving a microwave signal and a second waveguide portion 4*b* for outputting the received microwave signal. For example, the first waveguide portion 4*a* may be coupled to a rectangular hollow waveguide (e.g., waveguide 6) that receives a signal from a signal source (e.g., circuitry/device that generates a signal to be transmitted), and the second waveguide portion 4*b* may be coupled to another rectangular hollow waveguide (e.g., waveguide 8) that communicates the signal to a probe or the like as shown in FIG. 1. In the example provided in FIG. 3, the first and second waveguide portions are spaced about 0.65 inches apart from one another. The first and second waveguide portions 4*a* and 4*b* as well as the waveguides 6 and 8 may be formed, for example, from one or more of copper-plated plastic, aluminum, or other material suitable for forming a waveguide. A copper-plated plastic version is beneficial in that it is significantly lighter than traditional metal counterparts and much less expensive in volume production.

It is noted that while rectangular waveguide and waveguide portions are illustrated, other types of waveguides may be employed. For example, the first and/or second waveguides 6 and 8 and/or first and second waveguide portions 4*a* and 4*b* may be formed as a circular waveguide, ridged waveguide, elliptical waveguide, stripline, microstrip, etc.

A conductive pin 16 including an elongated portion 16*a* (best seen in FIG. 3) having a first end 16*b* and a second end 16*c* distal from the first end 16*b* is arranged relative to the first and second waveguide portions 4*a* and 4*b*. At least one of the first end 16*b* or second end 16*c* may be removable from the elongated portion 16*a* to enable assembly and/or disassembly of portions of the rotary joint 4. Further, a diameter of the elongated portion 16*a* preferably is less than a diameter of the first end 16*b* and the second end 16*c* to facilitate proper positioning and integration of the pin with respect to the housing.

More specifically, the first end 16*b* is arranged within the first waveguide portion 4*a* and the second end 16*c* is arranged within the second waveguide portion 4*b*. In this manner, the conductive pin 16 is fully exposed to the microwave signals within the respective waveguide portions. The conductive pin 16 may be formed, for example, from at least one of aluminum, copper, brass, or other conductive material. Preferably, the conductive pin 16, which forms a center conductor of a coaxial connection, is designed for improved power handling capabilities (e.g., minimum 100 W) compared to SMA-based (sub-miniature version A) coaxial rotary joints.

The power handling capabilities of the rotary joint depend on several factors, including the type of waveguide (e.g., circular vs. coaxial vs. other transmission medium). For a coaxial implementation, power handling will be driven by the cross section area (an increase in cross section results in an increase in power handling) and dielectric sleeve properties.

A sleeve 18 is arranged coaxial with the conductive pin 16, and may be formed, for example, of Polytetrafluoroethylene (also known under the trade name Teflon®), Polypropylene, Polystyrene, or other non-conductive materials. The sleeve 18 helps support the pin in place mechanically as the pin rotates, and its dielectric properties help reduce the cross section of the coaxial region.

A conductive material, such as aluminum, copper, brass, or other conductive material, is arranged on at least a portion of an outer surface of the sleeve 18 so as to form an outer conductor 20. The outer conductor 20 is electrically coupled to at least a portion of the first waveguide portion 4*a*.

The arrangement of the first end 16*b* relative to the first waveguide portion 4*a* forms a first waveguide-to-coaxial transition, and the arrangement of the second end 16*c* relative to the second waveguide portion 4*b* forms a second waveguide-to-coaxial transition. The respective transitions are coupled to one another via the conductive pin 16, which as noted above forms a center conductor of a coaxial connection. More specifically, the conductive pin 16, sleeve 18, and outer conductor 20 form a coaxial conductor that communicates the microwave signal from the first waveguide portion 4*a* to the second waveguide portion 4*b*. In this manner, RF coupling is provided between the first waveguide portion 4*a* and the second waveguide portion 4*b*. Moreover, and as will be shown below, the conductive pin 16 enables the first waveguide portion 4*a* and the second waveguide portion 4*b* to freely rotate relative to each other about a longitudinal axis 17 (FIG. 3) of the conductive pin 16. The waveguide rotary joint 4 can utilize a fixed coaxial microwave connection between the first waveguide portion 4*a* and the second waveguide portion 4*b*, yet provide a "floating" ground with beneficial direct-current (DC) electrical insulation/isolation properties.

In this regard, the coaxial conductor formed by the pin 16, sleeve 18 and outer conductor 20 is fixed relative to one waveguide portion (e.g., the first waveguide portion 4*a*) and floating relative to the other waveguide portion (e.g., the second waveguide portion 4*b*). Further, the conductive pin 16 of the coaxial conductor electrically float such that there is no direct-current contact between the first waveguide portion 4*a* and the second waveguide portion 4*b*.

Arranged between the first waveguide portion 4*a* and the second waveguide portion 4*b* is a choke cavity 22 (FIG. 3). Preferably, the choke cavity 22 exhibits a circular cross-section, although other cross-sections are contemplated. The choke cavity 22 can include a first (top) surface 24, a second (bottom) surface 26 opposite the first surface 24, and an exterior sidewall 28 connecting the first surface 24 to the second surface 26. The choke cavity 22 may be arranged concentric with the pin 16 such that they both share a common axis of rotation, namely, the longitudinal axis 17 of the pin 16.

The choke cavity 22 may further include an interior sidewall 30 connected to one or both of the first surface 24 and the second surface 26, the interior sidewall 30 spaced apart from the exterior sidewall 28. The first and second surfaces 24 and 26 and the exterior and interior walls 28 and 30 define the cavity, which may be filled with air or a dielectric material.

The choke cavity 22 can further include a center section 32 attached to the first and/or second surface 24 and 26, the center section 32 representing an extension of a mechanical seam that may present a potential pathway for undesired RF leakage. A center portion of the center section 32 includes an opening 32*a* (FIG. 3) configured to receive the sleeve 18. Preferably, the center section 32 of the choke cavity 22, the non-conducting sleeve 18, and the pin 16 are arranged concentric such that they all share a common axis (e.g., the axis 17 of the pin 16). While the center section is shown have a tapered "step" configuration, other configurations are possible (e.g., a non-stepped tapered configuration, etc.).

As seen in FIGS. 2 and 3, the sleeve 18 can include a shoulder 18*a* (FIG. 3) that interfaces with the center section 32 (i.e., the sleeve is rotationally symmetric but may be non-uniform in diameter along its length). The shoulder/center section interface helps align and fix a center of the conducting pin 16 within the center section 32. For example, during assembly the conducting pin 16 and non-conducting sleeve 18 can be pushed down until the shoulder 18*a* rests on the center section 32, thereby properly positioning both the pin and the sleeve. This construction dramatically improves the integration process compared to symmetrical designs, which typically do not utilize these hard stops and consequently have poor yields.

In the example shown in FIGS. 2 and 3, both the sleeve 18 and the opening 32*a* have a circular cross-section. However, since rotation of the choke cavity 22 relative to the sleeve 22 is not necessary, other cross sections are possible (e.g., a rectangular cross section, etc.). To ensure smooth rotation of the joint 4, a clearance preferably is provided, for example, between the second surface 26 of the choke cavity 22 and the second waveguide portion 4*b*. To provide free rotation while maintaining a low profile, preferably the clearance is between about 0.010-0.030 inches.

One or both of the first and second surfaces 24 and 26 of the choke cavity 22 can include an RF absorbing layer 34 arranged thereon. The RF absorbing layer 24 may include, for example, a rubber material embedded with iron particles, and may have a thickness on the order of 0.010 inches or higher. The RF absorbing layer 24 functions to dampen any leakage from the choke cavity 22 that might otherwise result in unwanted resonances. RF absorbing material employing a rubber-iron particle configuration is known in the art and therefore not described in further detail herein.

To enable rotation of the first waveguide portion 4*a* relative to the second waveguide portion 4*b*, an interface between the sleeve 18 and the first waveguide portion 4*a* is configured such that the first waveguide portion 4*a* can rotate relative to the sleeve 18, and thus relative to the second waveguide portion 4*b* (e.g., the sleeve 18 forms a close-fit free-rotating contact to a lower wall of the first waveguide portion 4*a*). The outer conductor 20 is mechanically and electrically joined to an upper wall of the second waveguide portion 4*b* and freely rotates relative to the first waveguide portion 4*a*. The choke cavity 22 seals what would otherwise be an RF leaking joint due to the small intentional mechanical air-gap present between the inner conducting surface of the outer conductor 20, and the concentric outer non-conducting surface of the sleeve 18, which allows for the free-rotation.

Optionally, a bearing (e.g., a circumferential bearing) may be used to provide rotation of the joint. Such bearing can be held in place, for example, via adhesive and retaining clamps. A cross-sectional area of the bearing and the retaining clamps can be used to tune the RF choke cavity design. The bearing provides a mechanical connection outboard of the RF absorber 34 and mechanically joins the upper waveguide portion 4*a* to the center-section 32. This (optional) bearing then both allows the upper waveguide portion 4*a* and center-section/lower-waveguide portion to rotate, and also keeps the assembly together. In summary the upper waveguide portion 4*a* rotates relative to center-section 32 and lower waveguide portion 4*b*, the latter two (center-section 32 and lower waveguide portion 4*b*) also being fixed to each other.

The resultant air gap combination for a choke, in addition to RF absorbing layer, provides a novel low-profile waveguide rotary joint using traditional manufacturing methods.

The waveguide rotary joint 4 in accordance with the present invention provides significantly lower profile relative to conventional Ku-Band versions when measured from centerline of the input waveguide to centerline of the output waveguide, as shown in FIGS. 2 and 3. Further, when compared to conventional coaxial rotary joints, the rotary joint 4 in accordance with the present invention provides 0.5 dB-1.5 dB lower loss, and when compared to SMA coaxial rotary joints, the rotary joint in accordance with the present invention can handle 2-10 times the power. In addition, improved impedance matching within the joint enables the height of the joint to be further minimized.

With respect to circular waveguide rotary joints, the rotary joint 4 in accordance with the present invention provides broader bandwidth (e.g., on the order of 3-10 times broader) while offering a 70% reduction in size and 50-90% reduction in cost. When compared to cable wrap implementations, the rotary joint 4 in accordance with the present invention is significantly less bulky, more reliable, and provides fully unrestrained continuous 360° rotation.

Figure 4:
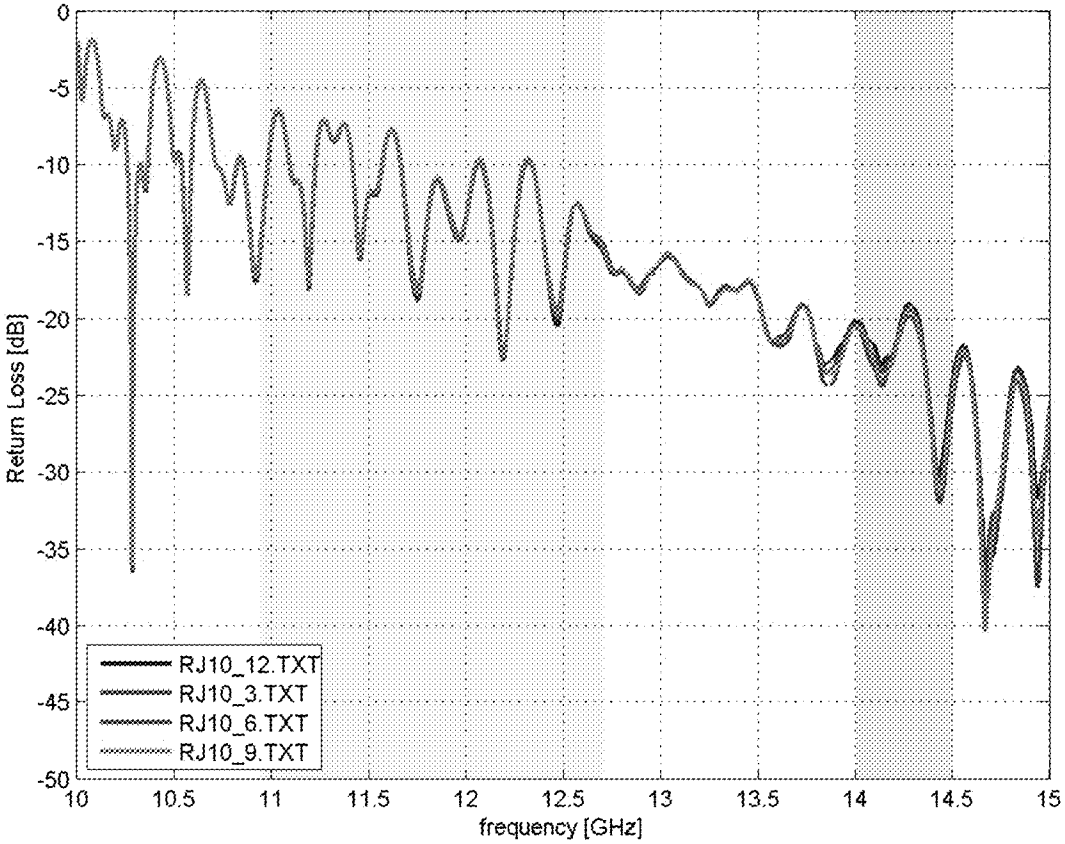
FIG. 4 graphically illustrates return loss vs. frequency through all rotations of the rotary joint.
Figure 5:
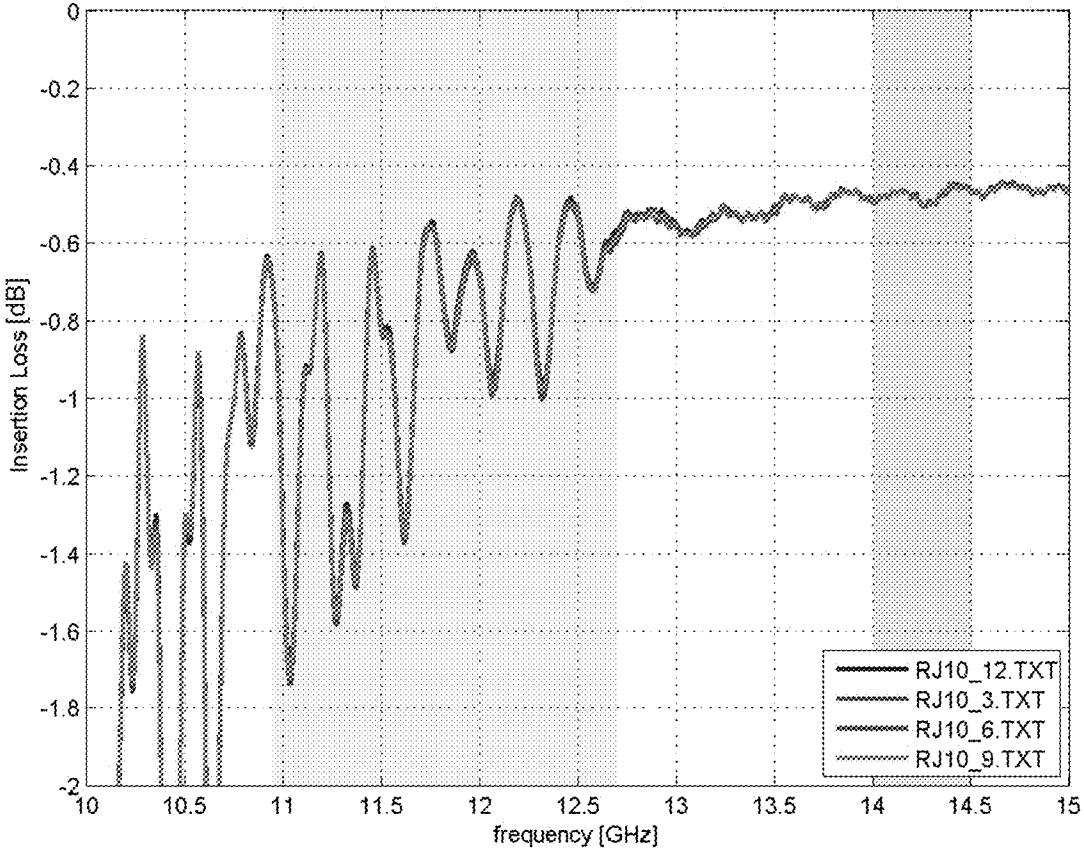
FIG. 5 graphically illustrates insertion loss vs. frequency through all rotations of the rotary joint.

Referring now to FIGS. 4 and 5, the measured return loss in dB (FIG. 4) and insertion loss in dB (FIG. 5) vs. frequency in GHz for a rotary joint in accordance with the present invention is graphically shown. More specifically, FIGS. 4 and 5 illustrate the performance of the rotary joint 4 over the transmission band (Tx) for various angular orientations (RJ10_12, RJ10_3, RJ10_6 and RJ10_9). As can be seen in both FIGS. 4 and 5, the performance is substantially the same over all rotations of the waveguide rotary joint 4. For completeness, the reception band Rx is also shown in FIGS. 4 and 5, which as can be seen substantially follows the transmission band Tx.

Moreover, the recordings shown in FIGS. 4 and 5 take into consideration the entire assembly (i.e., the insertion loss of the rotary joint 4 and the waveguides 6 and 8). Thus, the performance of the rotary joint itself is better than the performance of the entire assembly as shown in FIGS. 4 and 5.

Figure 6:
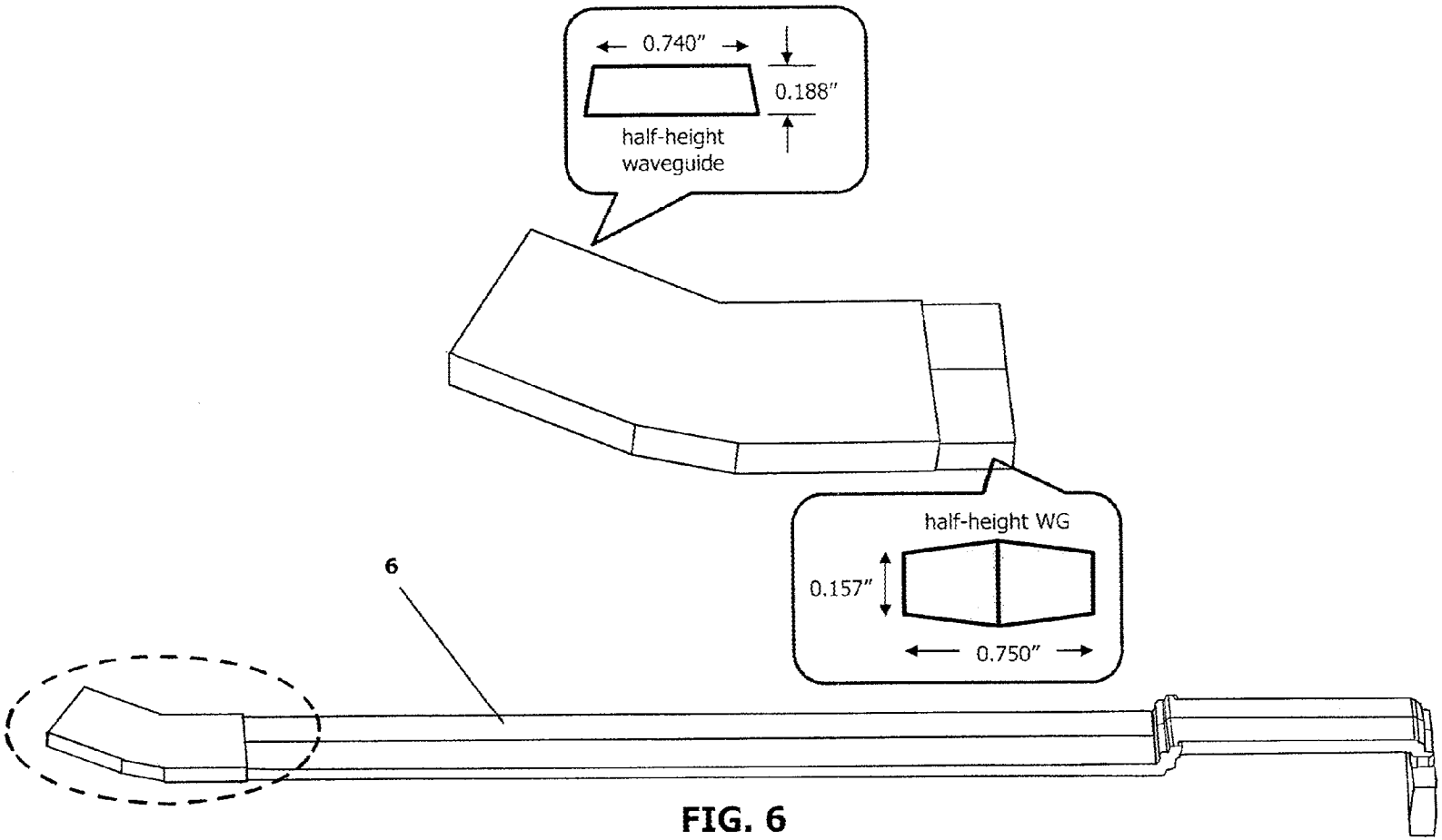
FIG. 6 illustrates an exemplary mating interface for the first waveguide connected to the rotary joint.
Figure 7:
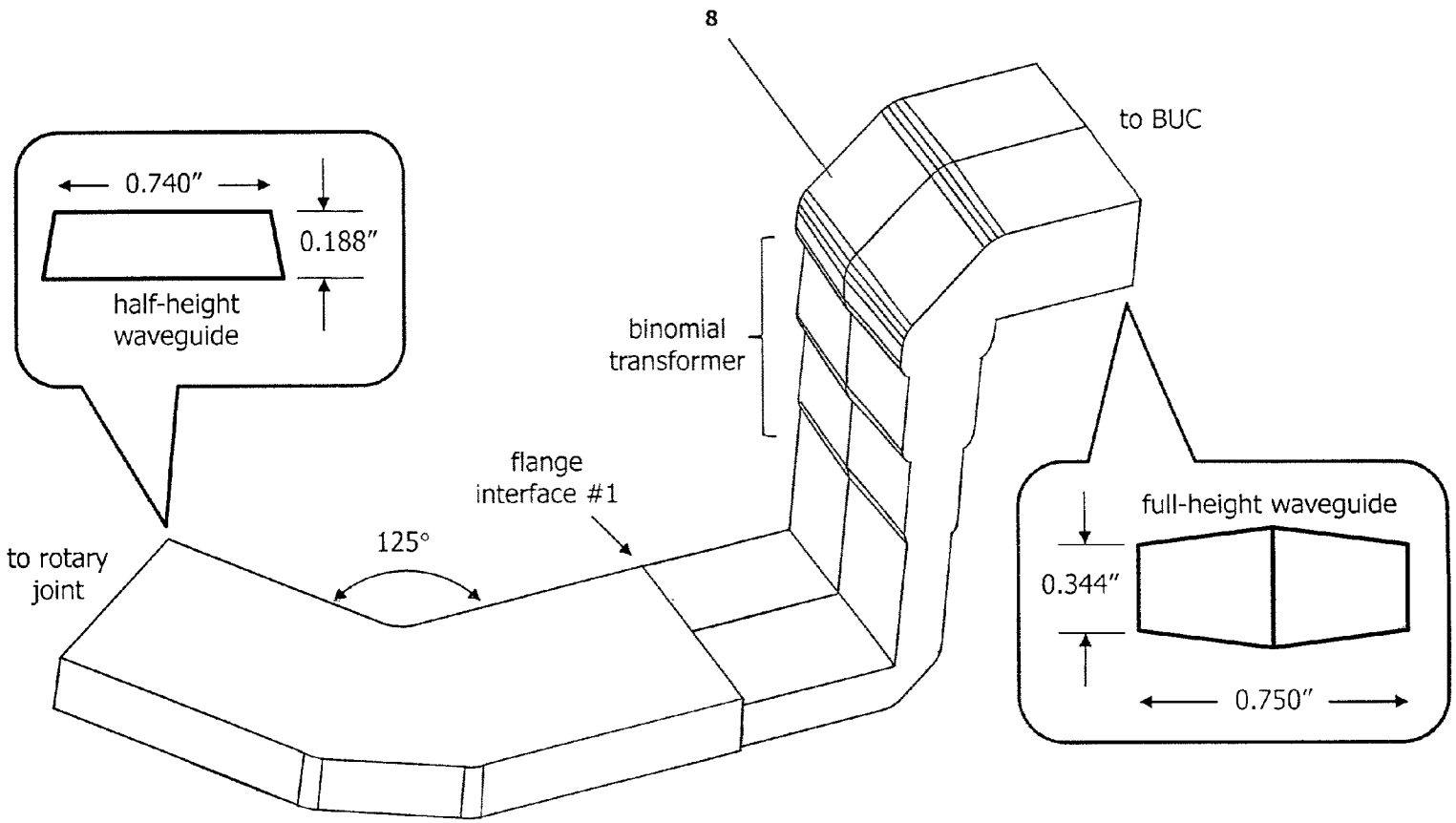
FIG. 7 illustrates an exemplary mating interface for the second waveguide connected to the rotary joint.

Moving now to FIGS. 6 and 7, the waveguides 6 and 8 are shown in more detail. The waveguides 6 (FIG. 6) and 8 (FIG. 7) are designed for low-loss and easy assembly. The exemplary waveguide of FIG. 6 includes a half-height waveguide having one end that is 0.75 inch wide and 0.157 inch high, and another end that is 0.740 inches wide and 0.188 inches high. The exemplary waveguide of FIG. 7 includes a half-height waveguide (which for example is coupled to the rotary joint) that is 0.740 inches wide and 0.188 inches high, and a full-height waveguide (which for example is coupled to the BUC) that is 0.75 inches wide and 0.344 inches high. Between the half-height waveguide and the full height waveguide is a 125 degree bend, a flange interface (flange interface #1) and a binomial transformer. These connecting waveguide thru pieces can be split midway along the waveguide broadwall where currents are minimal in order to minimize insertion loss while facilitating low-cost construction/assembly. In contrast, the waveguide portions 4*a* and 4*b* directly leading into and out of the waveguide rotating joint 4 in FIGS. 2 and 3 have their top and bottom covers soldered or braised together to eliminate any gaps. The connection interfaces between these different assemblies are optimized to ensure the RF signal traversing these junctions are well matched, as demonstrated by the measured return loss and insertion loss over rotation in FIGS. 4 and 5, respectively.

Although the invention has been shown and described with respect to a certain embodiment or embodiments, equivalent alterations and modifications may occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein exemplary embodiment or embodiments of the invention. In addition, while a particular feature of the invention may have been described above with respect to only one or more of several embodiments, such feature may be combined with one or more other features of the other embodiments, as may be desired and advantageous for any given or particular application.

What is claimed is:

1. A waveguide rotary joint, comprising:

a waveguide rotary joint portion including a first waveguide portion for receiving a microwave signal, and a second waveguide portion for outputting the received microwave signal;

a coaxial rotary joint portion including a conductive pin having a first end and a second end distal from the first end; and a choke cavity arranged between the first waveguide portion and the second waveguide portion, wherein the first end is arranged in and RF coupled to the first waveguide portion, the second end is arranged in and RF coupled to the second waveguide portion, and the first waveguide portion and the second waveguide portion are rotatable relative to each other about a longitudinal axis of the conductive pin, wherein the first waveguide portion and the second waveguide portion comprise half-height waveguides.

2. The waveguide rotary joint according to claim 1, wherein the coaxial rotary joint portion comprises a floating ground connection between the first waveguide portion and the second waveguide portion.

3. The waveguide rotary joint according to claim 2, wherein the floating ground connection is fixed relative to the first waveguide portion and floating relative to the second waveguide portion.

4. The waveguide rotary joint according to claim 3, wherein the conductive pin is arranged to electrically float such that there is no direct-current contact between the first waveguide portion and the second waveguide portion.

5. The waveguide rotary joint according to claim 1, wherein the choke cavity is defined by a first surface, a second surface opposite the first surface, and an exterior sidewall connecting the first surface to the second surface.

6. The waveguide rotary joint according to claim 5, wherein the choke cavity further comprises an interior sidewall connecting the first surface to the second surface, the interior sidewall spaced apart from the exterior sidewall.

7. The waveguide rotary joint according to claim 5, further comprising a center section coupled to at least one of the first surface or the second surface, wherein the center section is concentric with the choke cavity.

8. The waveguide rotary joint according to claim 7, wherein the center section is arranged in a center of rotation of the choke cavity.

9. The waveguide rotary joint according to claim 5, further comprising an RF absorbing layer arranged on the first surface and the second surface.

10. The waveguide rotary joint according to claim 9, wherein the RF absorbing layer comprises rubber embedded with iron particles.

11. The waveguide rotary joint according to claim 1, further comprising an sleeve coaxial with the conductive pin.

12. The waveguide rotary joint according to claim 10, further comprising a conductive material arranged on at least a portion of an outer surface of the sleeve, the conductive material electrically coupling the choke cavity to one of the first or second waveguides.

13. The waveguide rotary joint according to claim 12, wherein the conductive pin, sleeve, and the conductive material form a coaxial conductor.

14. The waveguide rotary joint according to claim 11, wherein the sleeve comprises Polytetrafluoroethylene.

15. The waveguide rotary joint according to claim 1, wherein the choke cavity comprises air.

16. The waveguide rotary joint according to claim 1, wherein the conductive pin comprises an elongated portion arranged between the first end and the second end, and a diameter of the elongated portion is less than a diameter of the first end and the second end.

17. The waveguide rotary joint according to claim 1, wherein the conductive pin comprises at least one of aluminum, copper or brass.

18. The waveguide rotary joint according to claim 1, wherein at least one of the first wave guide or the second wave guide comprises plastic plated with copper, or aluminum.

19. The waveguide rotary joint according to claim 1, further comprising a first waveguide coupled to the first waveguide portion and a second waveguide coupled to the second waveguide portion.

* * * * *